US008292538B2

(12) United States Patent
Morgan et al.

(10) Patent No.: US 8,292,538 B2
(45) Date of Patent: Oct. 23, 2012

(54) VEHICLE BARRIER CONTROL DEVICE

(76) Inventors: Mitch Morgan, Gainesville, GA (US); Ilan Lindenboim, Roswell, GA (US)

( * ) Notice: Subject to any disclaimer, the term of this patent is extended or adjusted under 35 U.S.C. 154(b) by 0 days.

(21) Appl. No.: 13/048,323

(22) Filed: Mar. 15, 2011

(65) Prior Publication Data

US 2011/0164920 A1 Jul. 7, 2011

Related U.S. Application Data

(63) Continuation of application No. 11/427,949, filed on Jun. 30, 2006, now abandoned.

(60) Provisional application No. 60/695,997, filed on Jul. 1, 2005.

(51) Int. Cl.
*E01F 13/04* (2006.01)

(52) U.S. Cl. ..... 404/6; 404/9; 404/11

(58) Field of Classification Search ..... 404/6–9, 404/11; 256/13.1

See application file for complete search history.

(56) References Cited

U.S. PATENT DOCUMENTS

| | | | | | |
|---|---|---|---|---|---|
| 1,217,651 | A | | 2/1917 | Sortland | |
| 2,528,790 | A | * | 11/1950 | Scherer | 235/99 A |
| 3,667,160 | A | | 6/1972 | Salloum | |
| 3,775,912 | A | * | 12/1973 | Walls | 49/131 |
| 3,805,448 | A | * | 4/1974 | Carr et al. | 49/49 |
| 3,838,760 | A | | 10/1974 | Selby | |
| 3,838,790 | A | * | 10/1974 | Naruse | 221/150 HC |
| 3,963,363 | A | * | 6/1976 | Roper | 404/9 |
| 4,354,771 | A | * | 10/1982 | Dickinson | 404/6 |
| 4,364,200 | A | * | 12/1982 | Cobb | 49/192 |
| 4,472,908 | A | | 9/1984 | Wanzl et al. | |
| 4,475,310 | A | * | 10/1984 | Brewer | 49/131 |
| 4,574,523 | A | * | 3/1986 | Nasatka | 49/49 |
| 4,627,763 | A | * | 12/1986 | Roemer et al. | 404/6 |
| 4,630,395 | A | * | 12/1986 | Nasatka | 49/49 |
| 4,681,479 | A | * | 7/1987 | Wagner et al. | 404/6 |
| 4,752,152 | A | * | 6/1988 | Crisp et al. | 404/6 |
| 4,811,516 | A | * | 3/1989 | Anderson | 49/49 |
| 4,818,136 | A | * | 4/1989 | Nasatka et al. | 404/6 |
| 4,897,960 | A | * | 2/1990 | Barvinek et al. | 49/49 |
| RE33,201 | E | * | 4/1990 | Dickinson | 404/6 |
| 4,998,843 | A | * | 3/1991 | Mothe | 404/6 |
| 5,009,542 | A | * | 4/1991 | Hardin et al. | 404/6 |

(Continued)

OTHER PUBLICATIONS

U.S. Official Action dated May 21, 2008 in U.S. Appl. No. 11/427,949.

*Primary Examiner* — Raymond W Addie
(74) *Attorney, Agent, or Firm* — Hope Baldauff Hartman, LLC

(57) ABSTRACT

A vehicle barrier control device for limiting vehicular access to an area. The vehicle barrier control device includes a barrier system having an active position and a passive position and a control system adapted to move the barrier system between the active position and the passive position. In the active position, the barrier system prevents vehicles from passing through. In the passive position, vehicles are permitted to pass through. The barrier system includes a buttress, movable barrier plate, traffic control arm and a traffic indicating light. The control system comprises a traffic arm motor, programmable logic controller, variable frequency drive, and actuator. The barrier system is temporarily bolted to a subframe set in concrete. An actuator motor mounted to an actuator reduces the need for typical hydraulic components. Using a variable speed and reversible actuator motor the present invention provides high-speed movements of the barrier plate for emergency conditions.

18 Claims, 11 Drawing Sheets

U.S. PATENT DOCUMENTS 5,146,710 A * 9/1992 Caldwell ..... 49/35
5,466,088 A * 11/1995 Nasatka ..... 404/6
6,179,517 B1 * 1/2001 Nelson ..... 404/6
6,382,869 B1 * 5/2002 Dickinson ..... 404/6
7,121,041 B2 * 10/2006 Anderson et al. ..... 49/49
7,775,738 B2 * 8/2010 Darcy ..... 404/6

* cited by examiner

VEHICLE BARRIER CONTROL DEVICE

CROSS REFERENCE TO RELATED APPLICATION

This application is a continuation of U.S. Patent Application No. 11/427,949, filed 30 Jun., 2006 now abandoned, which claims priority of U.S. Provisional Patent Application No. 60/695,997 filed 1Jul. 2005, the entire contents of which are hereby incorporated by reference.

TECHNICAL FIELD

The present invention relates generally to a vehicle barrier control device, and in particular to a vehicle barrier control device for use in controlling vehicular access to a secure roadway, parking area, building entrance, or other area where limited vehicular traffic is desired.

BACKGROUND OF THE INVENTION

In recent years there has been a dramatic increase in the incidence of attacks on facilities and buildings by terrorists, other aggressors such as extremists, and even disgruntled employees throughout the world. Many of these attacks are directed against government facilities or other high profile locations. One of the most effective means of facility destruction is through the use of a vehicle carrying explosives. To successfully guard against such attacks a standoff distance must be created around a facility. This is accomplished by the use of a combination of active and passive barriers. Passive barriers "never" allow vehicular access to certain areas, while active barriers are utilized to control or limit vehicular access to a particular area.

Active barriers range from simple devices that damage a vehicle's tires, such as the device described in U.S. Pat. No. 4,354,771 to Dickinson, to more complex devices such as the devices described in U.S. Pat. Nos. 4,574,523 and 4,630,395 to Nasatka. These more complex devices differ from earlier designed devices, such as the device described in U.S. Pat. No. 3,963,363 to Roper, which were designed to yield vehicular traffic, thereby acting more as a traffic guide than a traffic control. Current vehicular barrier designs seek to stop and immobilize unauthorized vehicles that collide with the barrier.

Since the Sep. 11, 2000 attacks on the U.S., a significant number of facilities are seeking active barrier solutions. The owners of such facilities, as well as the architectural design community, are demanding a more aesthetically pleasing active barrier solution. Facility owners and the general public do not want the streets to appear like a war zone with ominous looking barrier designs.

One of the biggest concerns with current barrier design is the use of hydraulic systems for the activation of the barrier, such as the barrier device described in U.S. Pat. No. 4,818,136 to Nasatka et al. and U.S. Pat. No. RE33,201 to Dickinson. These hydraulic systems must be routinely maintained or the barriers will eventually fail to operate. A typical hydraulic system must have its filters changed on a monthly basis or on a quarterly basis if the barrier is rarely used. The fluid in the hydraulic systems must also be changed at regular intervals similar to the oil in an ordinary car.

It is estimated that more than half of barrier system failures are related to the hydraulic system. A major source of failure in these hydraulic systems is related to the hoses and fittings. Even with the use of pneumatic systems in place of hydraulic systems, similar problems exist with hoses and fittings and system reliability. Another common failure point in hydraulic systems is that most hydraulic systems are designed to include solenoid valves, flow control valves, and accumulators that are used to control the movement and speed of movement of the barrier. These solenoid valves tend to fail often and are sensitive to the condition of the hydraulic fluid. The flow control valves are also sensitive to the condition of the fluid, while the accumulators have to be pre-charged to a certain operating pressure and must maintain that pressure. Small leaks or failures in the accumulators result in the barrier system not functioning properly. Typical hydraulic systems may contain fifteen gallons of fluid and in many cases more than double such amount. Additionally, typical hydraulic systems require a large hydraulic tank to act as a reservoir for the hydraulic fluid. In the event of a hydraulic system failure, such lost fluid creates an environmental hazard. Many of the systems installed today do not properly contain the fluid and, therefore, lost fluid will adversely impact the surrounding environment when a hydraulic system failure occurs.

One of the challenges with barriers designed to withstand the crash of a vehicle is designing a foundation to hold the barrier in place during impact. Current art solves this problem by providing a large in-ground barrier foundation, such as the device described in U.S. Pat. No 4,627,763 to Roemer et al., or by providing very large inertia blocks on the surface of the roadway as described in U.S. Pat. No. 6,382,869 to Dickinson.

Providing a large in-ground foundation is not always possible due to underground utilities or building structures. Further, the large inertia blocks on the surface of a roadway often are too large and limit the flow of traffic in the roadway. Many variations of the in-ground barrier are in use today. One of the biggest challenges is that the barrier and the foundation are essentially one unit, thereby making installation difficult at best. Another issue is that the local authorities, such as the Department of Transportation, may require that the barrier not be permanently attached to the road and be able to be easily removed from the road in the future, if so desired. None of the current art sufficiently solves these problems.

Another challenge with barrier design deals with the ability of the plate to withstand the crash of a vehicle. To overcome the large forces involved in a crash, current art utilizes reinforced and/or multi-layered plates to create a honeycomb effect and, thus, increase the robustness of the barrier plate. These designs have several disadvantages including, but not limited to, heavy construction, significant cost, and the need to go below the road surface to prevent the large structure from having to be above the roadway.

What is needed is an aesthetically pleasing vehicle barrier control device having a two-part barrier system, composed of an in-ground frame and a bolt down barrier, and a plate with a bend near the free end, that can utilize a self-contained motor and actuator, reversible motor and pump, and variable speed motor control. It is to such a device that the present invention is primarily directed.

BRIEF SUMMARY OF THE INVENTION

Briefly described, in preferred form, the present invention is a vehicle barrier control device for limiting and prohibiting vehicular access to a facility or area. The vehicle barrier control device includes a barrier system having an active position and a passive position and a control system adapted to move the barrier system between the active position and the passive position. When the barrier system is in the active position, the barrier system prevents vehicles from passing by or through the vehicle barrier control device. When the barrier system is in the passive position, the barrier system permits vehicles to pass by or through the vehicle barrier control device.

The barrier system can include a buttress, a movable barrier plate, a traffic control arm and traffic indicating light. The control system is containable within the buttress of the barrier system and comprises a traffic arm motor, a programmable logic controller, a variable frequency drive, and actuator. As directed by the programmable logic controller and variable frequency drive, the traffic arm motor moves the traffic control arm between a lowered position and a raised position, while the actuator moves the barrier plate from a raised position to a lowered position. When the vehicle barrier control device is in the active position, the traffic control arm is in the lower position and the barrier plate is in the raised position. When the vehicle barrier control device is in the passive position, the traffic control arm is in the raised position and the barrier plate is in the lowered position.

The barrier system further comprises a sub-frame that is typically set in concrete on a plane equal to the surface of the entryway or roadway to the secured facility or area. The rest of the barrier system is mounted to the sub-frame, but can be easily removed, if necessary. If removed, the sub-frame does not interfere with the traffic passing over the entryway or roadway, thereby making the vehicle barrier control device temporary. The combination of the buttress, traffic control arm, barrier plate, and sub-frame provides the strength and high-impact performance of a permanent barrier system, while providing a temporary vehicle barrier control device often required by a local department of transportation.

The actuator of the present invention provides a unique configuration, whereby an actuator motor is actually mounted onto the actuator. Accordingly, the actuator contains only a small amount of hydraulic oil for operation. Such a configuration eliminates the problems associated with typical hydraulic barrier systems, because the use of hoses, fittings, and solenoid control valves become unnecessary. Further, the present invention utilizes a variable speed and reversible actuator motor control to vary actuator pump speed to achieve high-speed movements of the barrier plate as needed in an emergency condition.

A principle object of the present invention is to provide a vehicle barrier control device having an active position that prevents vehicles from passing through and a passive position that allows vehicles to pass through the vehicle barrier control device.

Another object of the present invention is to provide a vehicle barrier control device having a traffic control arm and a barrier plate that are adapted to prevent traffic from passing through when in the active position and to allow vehicles to pass through when in the passive position.

Still another object of the present invention is to provide a vehicle barrier control device having an aesthetically pleasing barrier design that can combine finishes and colors to match the architectural design of the facility being secured, thereby giving the engineers and architects, who design buildings with vehicular intrusion solutions, the ability to maintain the artistic design of the facility.

It is another object of the present invention to provide a vehicle barrier control device that comprises a self-contained motor and actuator containing only a small amount of hydraulic oil based on the revolutionary design of mounting the motor onto the actuator, thereby eliminating the problems caused by traditional hydraulic systems.

Yet another object of the present invention is to provide a vehicle barrier control device that eliminates the need for hoses and fittings thus eliminating critical failure points found in current barrier systems.

Another object of the present invention is to provide a vehicle barrier control device that eliminates the problems associated with the use of solenoid control valves by utilizing a reversible motor and pump to control the direction of the barrier's movements rather than utilizing directional solenoid control valves.

Still another object of the present invention is to provide a vehicle barrier control device that eliminates the problems associated with the use of flow control valves and/or accumulators by utilizing a variable speed motor control to vary pump speed to achieve high speed movements as needed in an emergency condition.

It is another object of the invention to provide a vehicle barrier control device utilizing a two part barrier system, composed of an in ground frame and a bolt down barrier, thereby eliminating the need for large inertia blocks above the surface or the need for a large foundation below the surface.

Yet another object of the present invention is to provide a vehicle barrier control device that allows the barrier to be removed only leaving the frame in the roadway, which can be driven over, thus meeting local authority's removability requirements.

Another object of the present invention is to provide a vehicle barrier control device that provides a plate with a bend near the free end of the barrier's plate, thereby increasing the strength of the plate without having to create a honeycomb or reinforcing structure, and allowing the plate to slope down in the front and eliminate the "bump" at the front of the barrier plate.

These and other objects, features and advantages of the present invention will become more apparent upon reading the following specification in conjunction with the accompanying drawings.

DETAILED DESCRIPTION OF THE PREFERRED EMBODIMENTS

Figure 1:
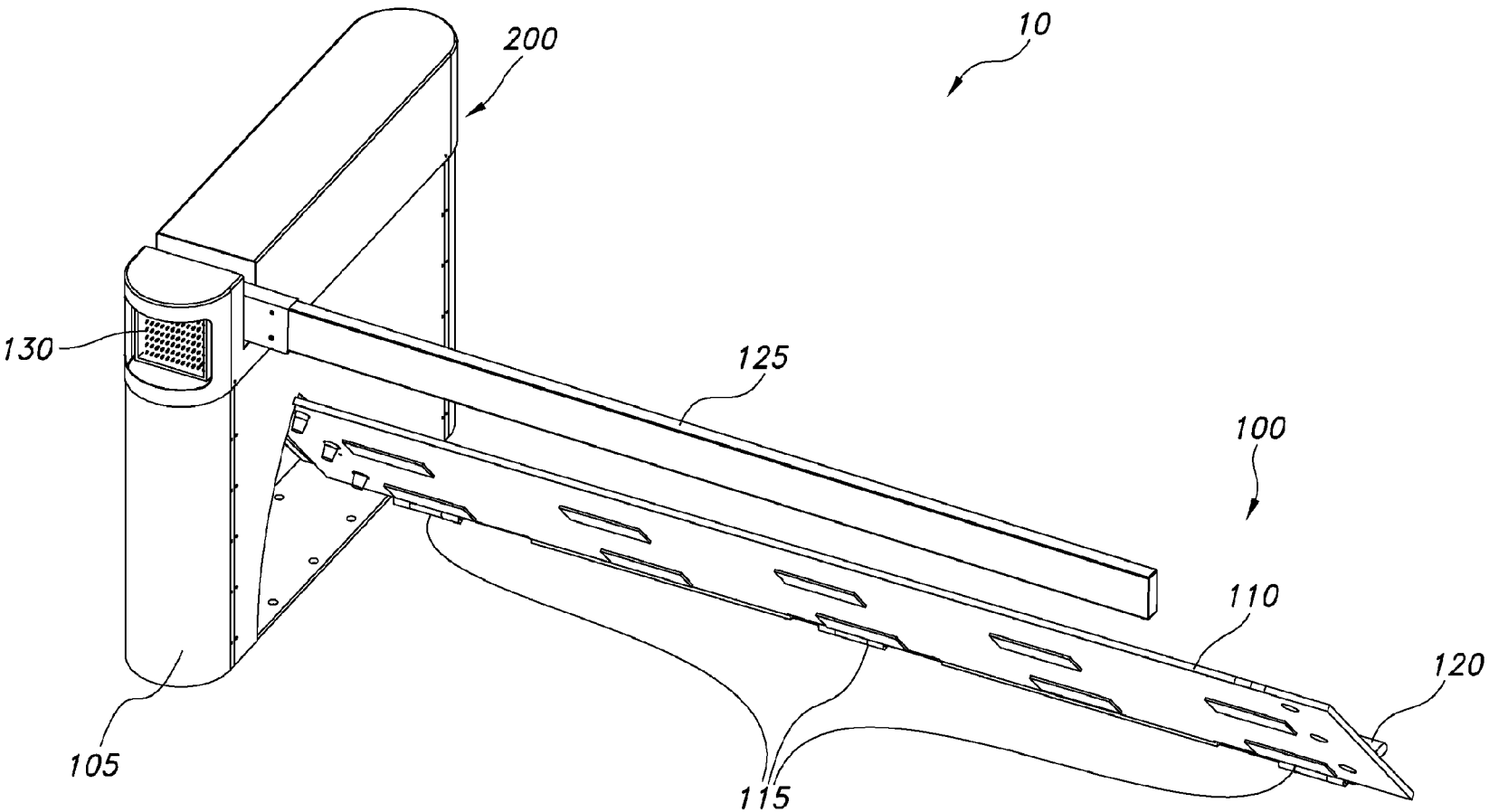
FIG. 1 illustrates a perspective view of a vehicle barrier control device in an active position in accordance with preferred embodiments of the present invention.

Referring now in detail to the drawing figures, wherein like reference numerals represent like parts throughout the several views, a vehicle barrier control device 10 of FIG. 1 is designed for preventing and limiting vehicular access to a particular area. The vehicle barrier control device 10 provides an aesthetically pleasing barrier design, while eliminating multiple problems of previously designed barriers. The vehicle barrier control device 10 can be configured in various sizes and shapes conducive to an entryway of the restricted area and, more particularly, for controlling vehicular access into a facility or an area where limiting vehicular access to unauthorized vehicles is desired.

As illustrated in FIG. 1, the vehicle barrier control device 10 comprises a barrier system 100 and a control system 200. The barrier system 100 has an active (or guard) position and a passive position, such that vehicles cannot pass by the vehicle barrier control device 10 when the barrier system 100 is in the active position and vehicles are permitted to pass through the vehicle barrier control device 10 when the barrier system 100 is in the passive position. The control system 200 is adapted to move the barrier system 100 between the active position and the passive position and, thereby, limits vehicular access to a particular facility or area secured by the vehicle barrier control device 10. Accordingly, the particular facility or area to be secured by the vehicle barrier control device 10 is accessible by vehicles when the barrier system 100 is in the passive position, but is inaccessible by vehicles when the barrier system 100 is in the active position.

The barrier system 100 of the vehicle barrier control device 10, as shown in FIG. 1, comprises a buttress 105, a movable plate 110, a frame 120 anchored into the ground or other stationary object, a plurality of hinges 115 in communication with the plate 110 and the frame 120, an optional traffic control arm 125, and an optional traffic indicating light 130 in communication with the buttress 105. When the barrier system 100 is in the active (or guarded) position, the movable barrier plate 110 is in a raised position, the traffic control arm 125 is in a lowered position, and the traffic indicating light 130 is red. In the raised position, the movable barrier plate 110 provides a sufficiently impassable obstacle and, therefore, prevents the wheels or tires of a vehicle from passing through the vehicle barrier control device 10. In the lowered position, the traffic control arm 125 is generally parallel and horizontal to the pathway leading to the protected facility or area, thereby preventing a vehicle from passing through the vehicle barrier control device 10. Further, the traffic indicating light 130 provides a red warning light notifying individuals operating the vehicles that access through the vehicle barrier control device 10 is not permitted.

Figure 2:
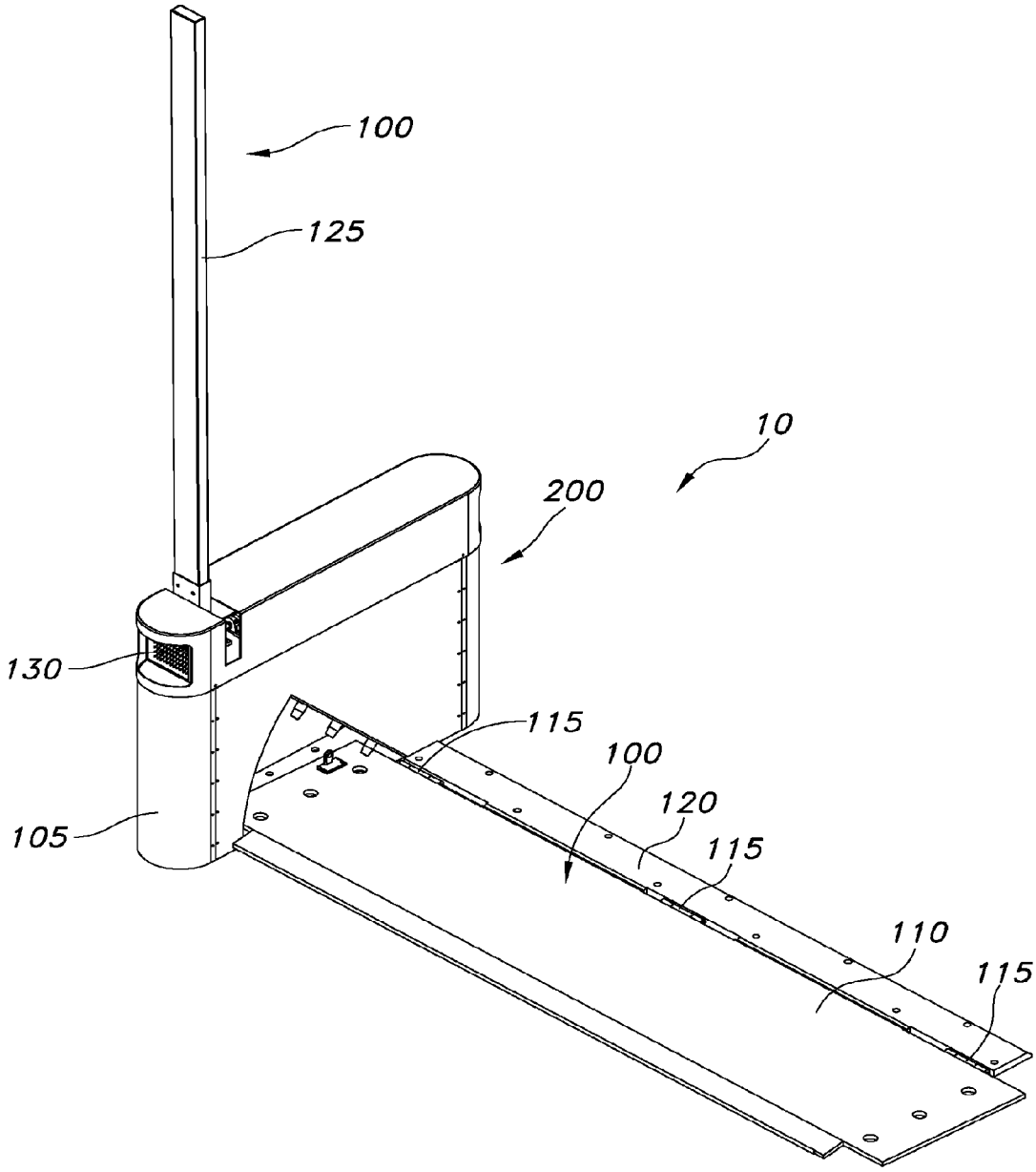
FIG. 2 illustrates a perspective view of the vehicle barrier control device in a passive position in accordance with preferred embodiments of the present invention.

When the barrier system 100 is in the passive position, as shown in FIG. 2, the movable barrier plate 110 is in a lowered position, the traffic control arm 125 is in a raised position, and the traffic indicating light 130 is green. In the lowered position, the movable barrier plate 110 provides a clear and unobstructed path and, therefore, permits the wheels or tires of a vehicle to pass through the vehicle barrier control device 10. In the raised position, the traffic control arm 125 is generally perpendicular and vertical to the pathway leading to the protected facility or area, thereby permitting a vehicle to pass through the vehicle barrier control device 10. Further, the traffic indicating light 130 provides a green light notifying individuals operating the vehicles that access through the vehicle barrier control device 10 is currently allowed.

The unique design of the present invention integrates the traffic control arm 125 and the traffic indicating light 130 into the buttress 105 of the vehicle barrier control device 10 to simplify installation and reduce installation costs.

The control system 200 comprises a traffic arm motor 205 (not shown) and a traffic arm high reduction gear box 210 (not shown), such that the traffic arm motor 205 and traffic arm high reduction gear box 210 are adapted to move the traffic control arm 125 between the lowered and raised positions. Generally, the traffic arm motor 205 and the traffic arm high reduction gear box 210 are containable within the buttress 105 of the vehicle barrier control device 10. In a preferred embodiment of the present invention, the traffic arm motor 205 is a three phase 230 volt 1750 revolutions per minute (rpm) motor such as manufactured by Baldor Electric or Leeson Motor. Additionally, in a preferred embodiment, the traffic arm high reduction gear box 210 is a 60:1 double reduction gearbox such as manufactured by Baldor Electric or LeCentric.

The control system 200 further comprises a programmable logic controller (PLC) 215 and a variable frequency drive 220, such that the PLC 215 and the variable frequency drive 220 are adapted to control the speed and direction of the traffic arm motor 205, thereby controlling the lifting and lowering of the traffic control arm 125 to the raised and lowered positions, respectively. A special feature of the control system 200 and, more particularly, the variable frequency drive 220 is the ability to use a standard single-phase 230 volt alternating current (AC) power source and convert such received power to three phases for the three-phase traffic control motor 205. This power conversion significantly reduces the cost of installing the vehicle barrier control device 10 by not requiring a special transformer to provide the three-phase power source. Further, a three-phase traffic control motor 205 is more cost efficient and more effective. In comparison, a single-phase power source is identical to what would be used to power a typical air-conditioner in a guard booth.

The traffic control arm 125 can be constructed using a variety of suitable materials, such as an aluminum square tube. In a preferred embodiment of the present invention, the traffic control arm 125 is a square tube having a length between eight and twelve feet, a height of approximately five inches, and a thickness of approximately two inches.

The traffic indicating light 130 is, preferably, of a special construction. The traffic indicating light 130 is a multi-colored light emitting diode (LED) having both red and green LEDs. Accordingly, only one traffic indicating light 130 is necessary for both the red and green indicating conditions, thus significantly improving the aesthetic qualities of the buttress 105 of the vehicle barrier control device 10.

Figure 3B:
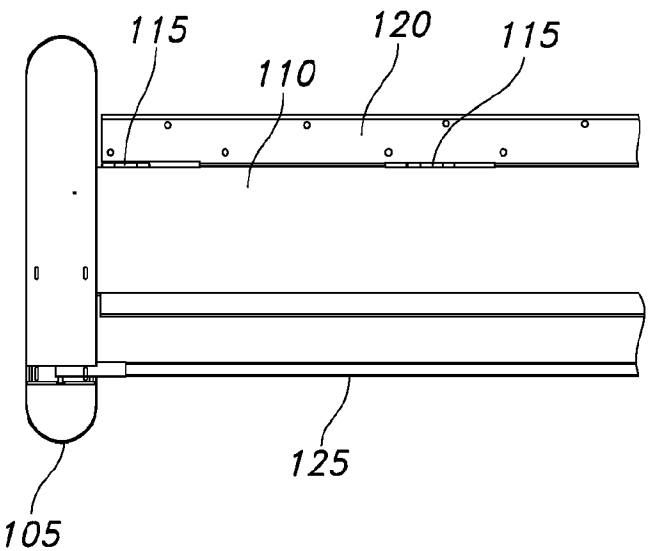
FIG. 3 illustrates a perspective view of a buttress of the vehicle barrier control device having a round contour shape in accordance with preferred embodiments of the present invention.
Figure 3A:
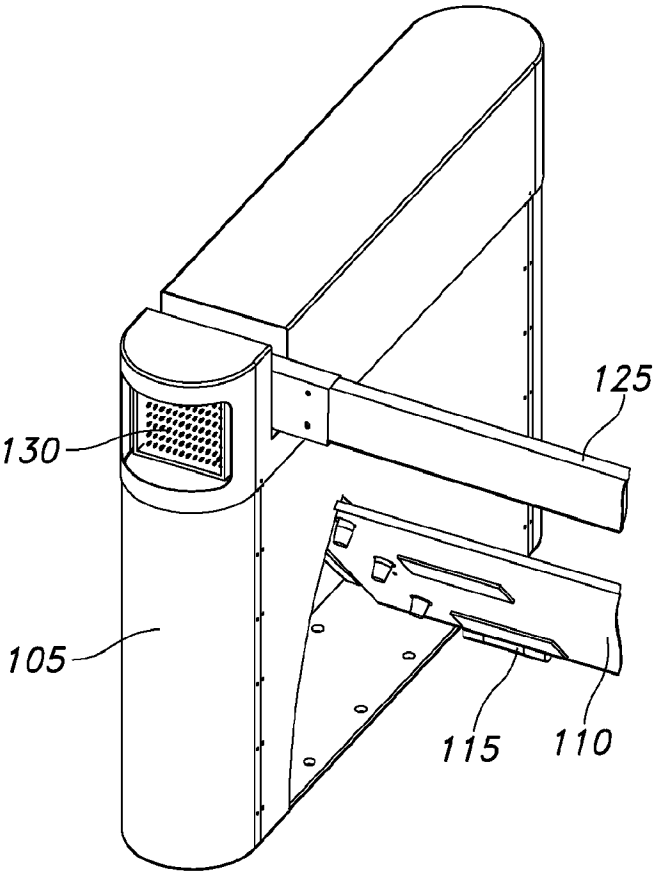

The vehicle barrier control device 10, as shown in FIG. 3, provides a unique structural design that incorporates a buttress 105 having a rounded front and back structure. This design of the buttress 105 emulates the shape of a bollard, thereby making the vehicle barrier control device 10 more aesthetically pleasing. By incorporating the half bollard shape into the buttress 105 of the vehicle barrier control device 10, the need to place an additional bollard in front of the vehicle barrier control device 10 is eliminated. The radius of the arcs shaped by the front and back structures of the buttress 105 is generally equal to the width of the buttress 105. In a preferred embodiment of the present invention, the optimal aesthetic width for the buttress 105 is approximately twelve inches and, therefore, the radius of the arcs of the front and back structures is also approximately twelve inches. This revolutionary shape allows the vehicle barrier control device 10 of the present invention to fit into the architectural decor of the facility or area being protected.

Figure 4A:
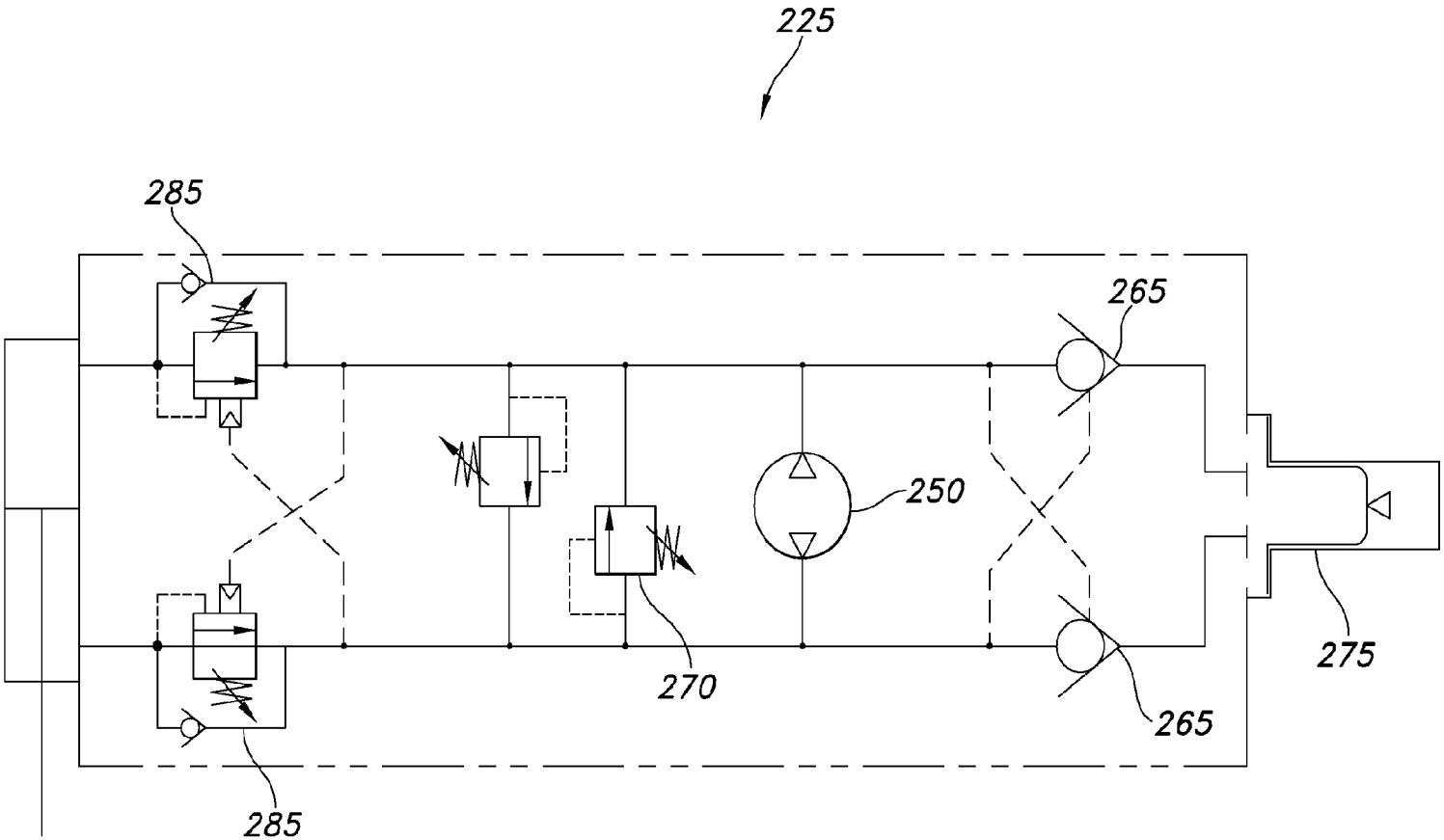
FIGS. 4A-4B, collectively known as FIG. 4, illustrate a hydraulic schematic having a direct coupling of a pump to an actuator in accordance with preferred embodiments of the present invention and a typical hydraulic schematic of the prior art, respectively.

The control system 200 further comprises an actuator 225, as illustrated in FIG. 4A, which provides another unique feature of the vehicle barrier control device 10. The actuator 225 is adapted to move the plate 110 between the passive position (lower position) and the active position (raised position). The actuator 225 is in communication with the plate 110 through a clevis 230 (not shown), bearings 235 (not shown), and a connecting shaft 240 (not shown). The clevis 230 can be mounted on the actuator 225 containing bearings 235 to allow the connecting shaft 240 to rotate as the plate 110 is moved between the passive position and the active positions. Generally, the connecting shaft 240 is fixed to the plate 110 with bolts to allow the connection shaft 240 to be removed from the plate 110 during maintenance.

The control system 200 is adapted to provide correct signals to power the actuator 225 during use, thereby making the actuator 225 and control system 200 interdependent. The actuator 225 of the present invention is a special design that combines the benefits of hydraulic fluid power and the benefits of an electrical drive system. FIG. 4A illustrates the control diagram of the actuator 225 of the vehicle barrier control device 10. In a preferred embodiment of the present invention, the actuator 225 comprises and utilizes an actuator motor 245 in communication with an actuator pump 250. For example and not limitation, the actuator motor 245 can be directly mounted on the actuator pump 250. The actuator pump 250 is in communication with an actuator valve manifold 255 (not shown) adapted to carry fluid to a cylinder 260. For example, the actuator pump 250 can be directly mounted on the actuator valve manifold 255. This "closed" system design eliminates the numerous problems associated with a typical hydraulic actuator control system like the one shown in FIG. 4B.

The control system 200 can further comprise an actuator motor 245, an actuator pump 250, and an actuator valve manifold 255 (not shown). The actuator motor 245 is adapted to turn the hydraulic actuator pump 250 used to pressurize the fluid within the cylinder 260. Moreover, the control system 200 can comprise pilot operated check valves 265 adapted to maintain the position of the cylinder 260 when the actuator motor 245 is stopped, and special cushioning relief valves 270 adapted to prevent hydraulic overload and provide smooth transition when changing the direction of the actuator motor 245.

Still further, the control system 200 comprises a volume compensator 275, as illustrated in FIG. 4A. In a preferred embodiment of the present invention, the unique volume compensator 275 allows the actuator 225 to be placed in any orientation and is not affected by gravity acting on the fluid. Such a volume compensator 275 can include the volume compensator provided by and patented by M-Mac Actuators. The M-Mac designed actuator 225 has significant advantages over other similar systems not utilizing this type of volume compensator 275. In a preferred embodiment of the present invention, the actuator motor 245 includes a three-phase 230 volt 1750 rpm motor such as the actuator motor 245 manufactured and provided by Baldor Electric.

Figure 5:
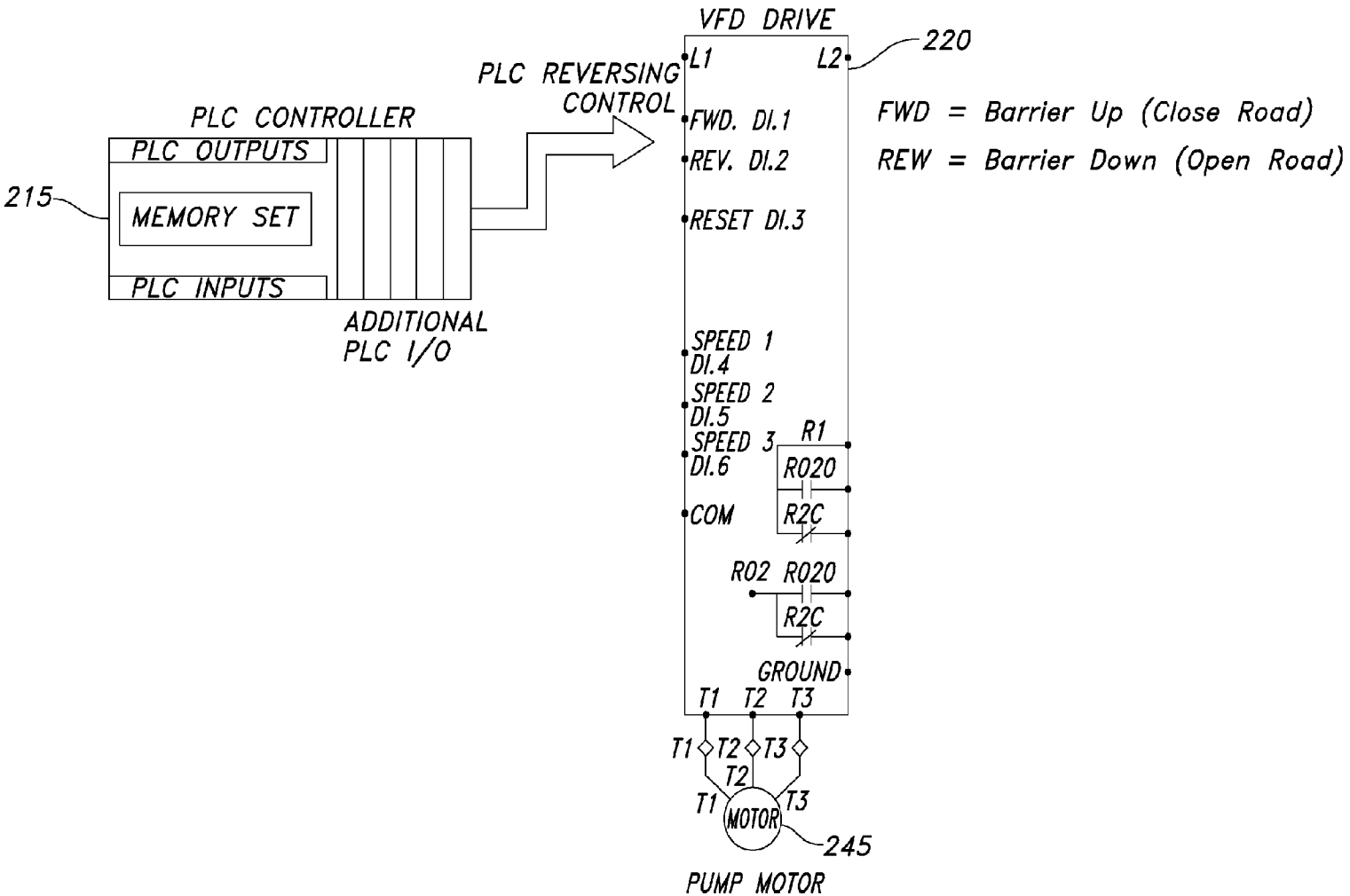
FIG. 5 illustrates an electrical schematic showing a method for reversing pump control in accordance with preferred embodiments of the present invention.
Figure 6:
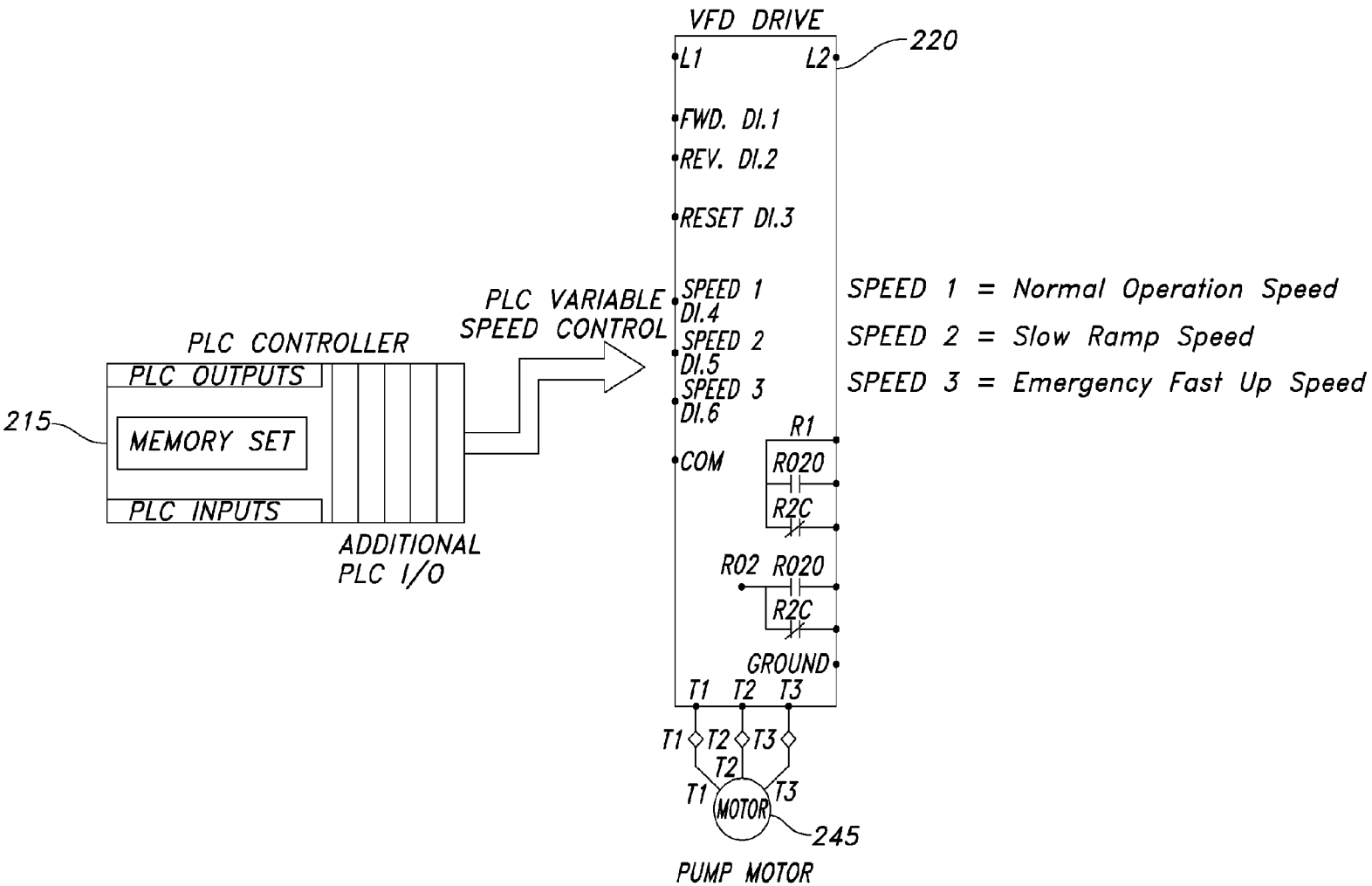
FIG. 6 illustrates an electrical schematic showing a method for variable speed control for movements of the vehicle barrier control device in accordance with preferred embodiments of the present invention.

As described above, the control system 200 comprises a variable frequency drive 220 and a programmable logic controller (PLC) 215 adapted to control the speed and direction of the actuator motor 245 and, thus, the speed and direction of the actuator 225, as illustrated in FIGS. 5 and 6. The variable frequency drive 220, as shown in FIG. 5, is adapted to reverse the direction of the actuator 225 by simply reversing the direction of the actuator motor 245, without the need for additional special hydraulic directional control valves. By not requiring special hydraulic directional control valves, the vehicle barrier control device 10 of the present invention provides a simpler and more reliable barrier system than those currently used.

The variable frequency drive 220, as shown in FIG. 6, is adapted to change the speed of the actuator 225 near the end of the stroke and also to provide for a higher actuator 225 speed for an emergency activation function. Accordingly, the variable frequency drive 220 permits the actuator 225 to gently stop the movement of the plate 110 as it reaches the fully lowered and the fully raised position (e.g., the passive position and the active position, respectfully). Such a "soft landing" ability of the plate 110 significantly reduces the shock absorbed by the vehicle barrier control device 10 and, more specifically, the plate 110 and, thus, increases the life of the components of the vehicle barrier control device 10, while still providing for the fast emergency activation of the vehicle barrier control device 10 when required. For example and not limitation, the vehicle barrier control device 10 can quickly move from the passive position to the active position when an emergency occurs, thereby preventing unauthorized access of a dangerous vehicle.

All of these control functions are accomplished without adding special hydraulic control valves typically required to perform such functions. A special feature of the vehicle barrier control device 10 and the variable frequency drive 220 is the ability to use standard single phase 230 volt AC power and convert that power to three-phase power for the three-phase actuator motor 245. Such a sealed hydraulic power source significantly reduces the cost of installing the vehicle barrier control device 10 by not requiring a special transformer to provide the three-phase power source. This optimal variable frequency drive 220 solution can be accomplished with a special variable frequency drive 220 and PLC 215 as manufactured by Automation Direct.

Figure 4B:
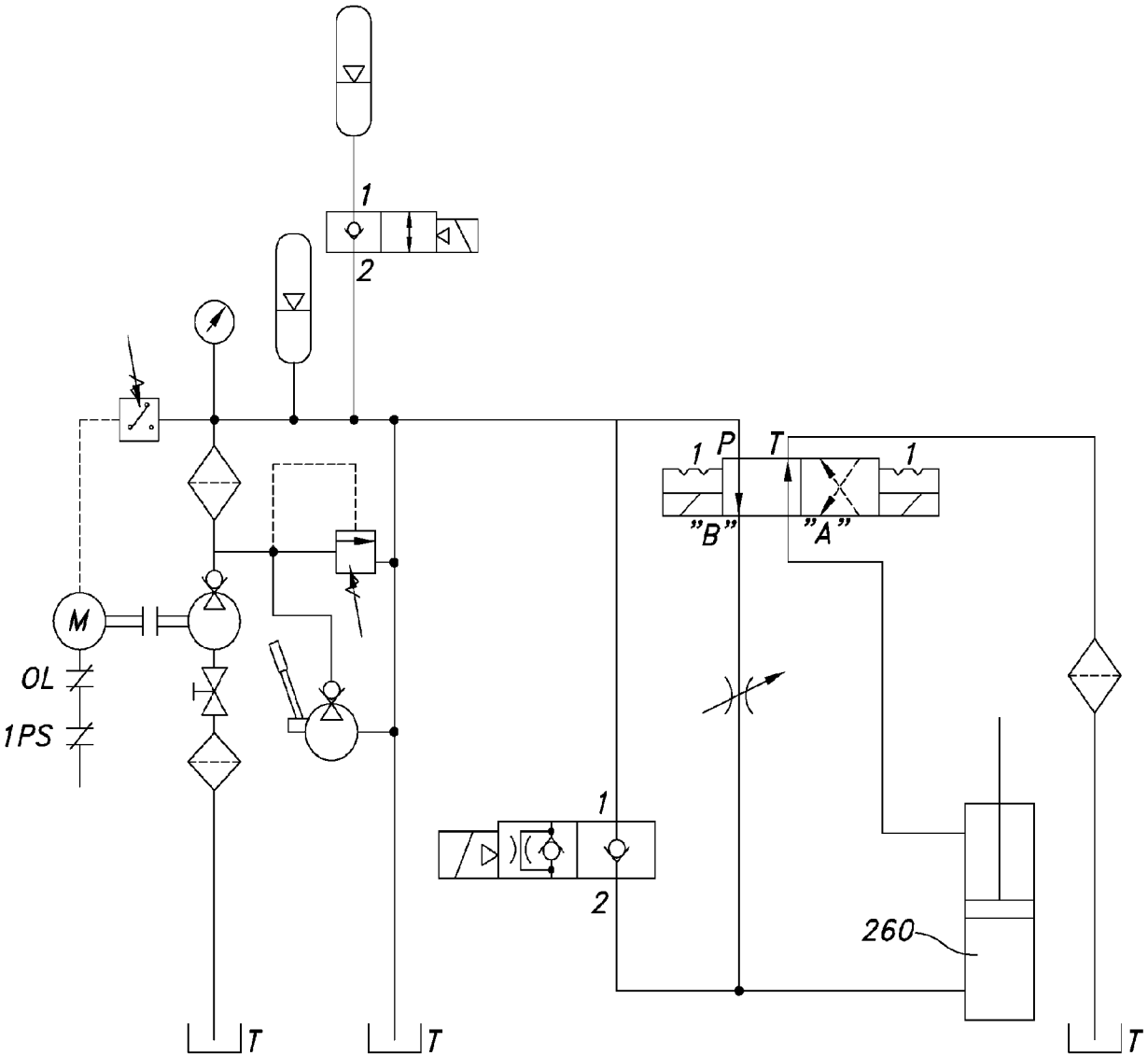
FIG. 4B (PRIOR ART)

As illustrated in FIG. 4B, the typical hydraulic actuator control system contains many valves, hoses and pipes, fittings, a filter, and large reservoir tank. All of these components can be points of failure and, thus, reduce the reliability of the barrier system. These component failures are typical of all such hydraulic systems regardless of the application in which the components are applied. However, when applied to security system applications the components become intolerable.

Figure 7:
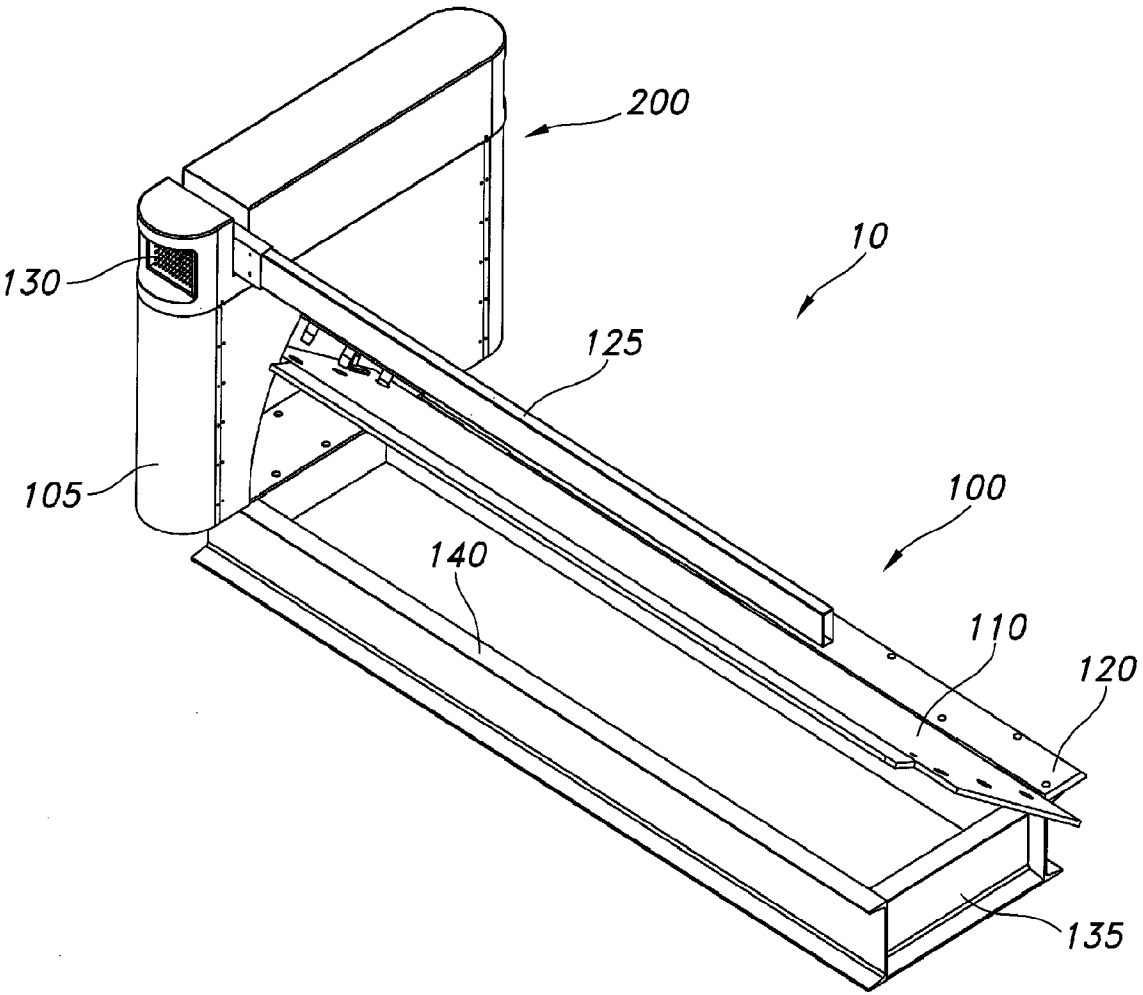
FIG. 7 illustrates a perspective view of the vehicle barrier control device having a separate sub-frame in accordance with preferred embodiments of the present invention.

In addition to comprising a buttress 105 (with integrated traffic indicating lights 130 and a traffic control arm 125), a moving plate 110, and a support frame 120, the barrier system 100 further comprises an in-ground sub-frame 135, as illustrated in FIG. 7. The modular design of the separate sub-frame 135 makes the vehicle barrier control device 10 easier to install, repair, or replace (if damaged), and even remove from the roadway, if necessary. Typically, the local department of transportation must classify the vehicle barrier control device 10 as temporary before the vehicle barrier control device 10 can be placed into a roadway or similar area. Current barrier systems cannot be installed temporarily and, therefore, may not meet the requirements of the department of transportation. The vehicle barrier control device 10 of the present invention, however, meets the requirement for a temporary barrier and, yet, provides a higher level crash rating than that of a permanent in-ground barrier.

The vehicle barrier control device 10 can be installed by first incorporating the sub-frame 135 into a shallow concrete pad. The sub-frame 135 is set into the concrete on a plane equal to the surface of the roadway. The sub-frame 135 is typically inserted into a foundation of approximately four to twelve inches in depth. In a preferred embodiment of the present invention, the sub-frame 135 is within a foundation of approximately six to eight inches in depth. Once the sub-frame 135 is installed, then the barrier plate 110 and buttress 105 are bolted down to the in-ground sub-frame 135 using, for example, grade three or above steel bolts. If the vehicle barrier control device 10 must be removed, the vehicle barrier control device 10 is simply unbolted from the sub-frame 135 and removed. The remaining sub-frame 135 is flush with the road surface and, therefore, can be driven over without any further modifications. Typically, the sub-frame 135 is constructed of a steel c-channel approximately six inches in height. A steel box (rectangle) is formed by welding the c-channel into a front anchor member, back anchor member, and two side anchor members, with the c-channel facing outward. Four pieces of additional c-channel can be placed inside of this steel frame, such that the four pieces (support anchor members) of additional c-channel run parallel front to back. The sub-frame 135 actually extends the length of the vehicle barrier control device 10. Generally, the sub-frame 135 extends approximately one foot in front of the buttress 105 of the vehicle barrier control device 10. This sub-frame extension 140 provides the additional structure support needed to withstand a higher kinetic energy upon vehicle impact with the vehicle barrier control device 10.

By utilizing the in-ground sub frame 135 to which the vehicle barrier control device 10 is bolted, the present invention eliminates the need for large inertia blocks above the surface and also eliminates the need for a large foundation below the surface, because the vehicle barrier control device 10 is generally a hybrid of the two.

Figure 8:
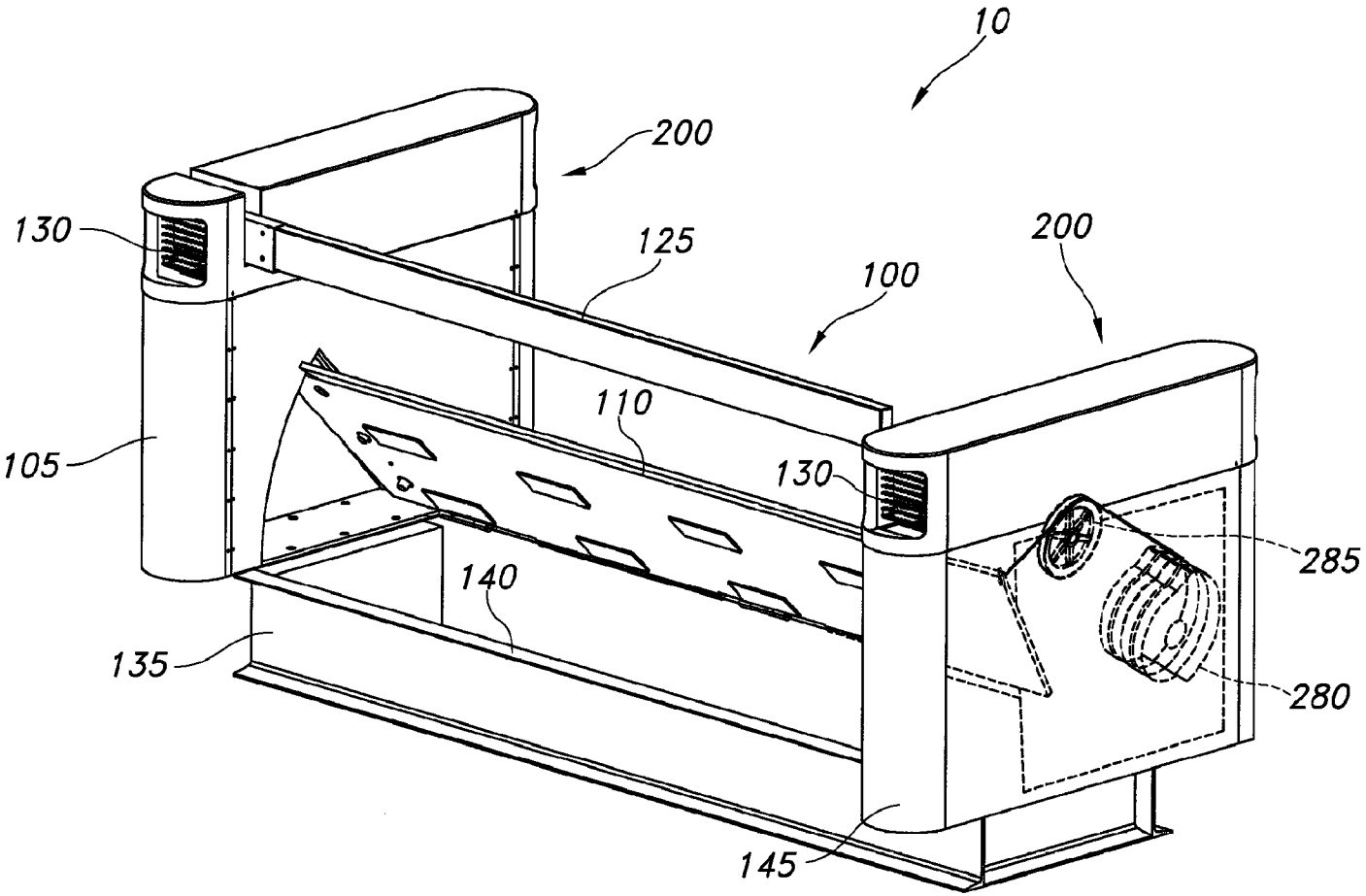
FIG. 8 illustrates a perspective view of the vehicle barrier control device having a lifting mechanism in one buttress and a counterbalance mechanism in a second buttress in accordance with preferred embodiments of the present invention.

As the width of the vehicle barrier control device 10 increases, the need for a second lifting mechanism 280 is also increased. Accordingly, the control system 200 can comprise a second lifting mechanism 280 adapted to balance the lift and more evenly distribute the load. This second lifting means 280 is usually identical to the lift mechanism (e.g., actuator 225, actuator motor 245, actuator pump 250, programmable logic controller 215, variable frequency drive 220, etc.) contained within the original buttress 105, but is generally located in a separate, second buttress 145, as illustrated in FIG. 8.

Additionally, for a vehicle barrier control device 10 with a larger width, the control system 200 further comprises a counter balance mechanism 285 in communication with the second lifting mechanism 280. The second lifting mechanism 280, as illustrated in FIG. 8, is 100% mechanical and does not require any control or electrical interface. Such a configuration eliminates the need for additional wiring and simplifies the installation of the vehicle barrier control device 10 and reduces cost. In a preferred embodiment, the second lifting mechanism 280 comprises a weight connected to the plate 110 utilizing a flexible steel aircraft grade cable 150. The flexible cable 150 of the barrier system 100 can be attached to the plate 110 via a mounting plate 155 welded to the plate 110 and a bolt to attach the flexible cable 150 to the mounting plate 155. The optimal weight strength of the flexible cable 150 is between 40% and 60% of the total plate 110 weight. Such a configuration allows the control for the first lifting mechanism (e.g, the actuator 225 and controls, etc.) to be the same design as for the narrow plates 110. Accordingly, a single design of the vehicle barrier control device 10 can be utilized for varying widths of the vehicle barrier control device 10, thereby reducing the costs of implementing narrow and wide barriers.

Figure 9:
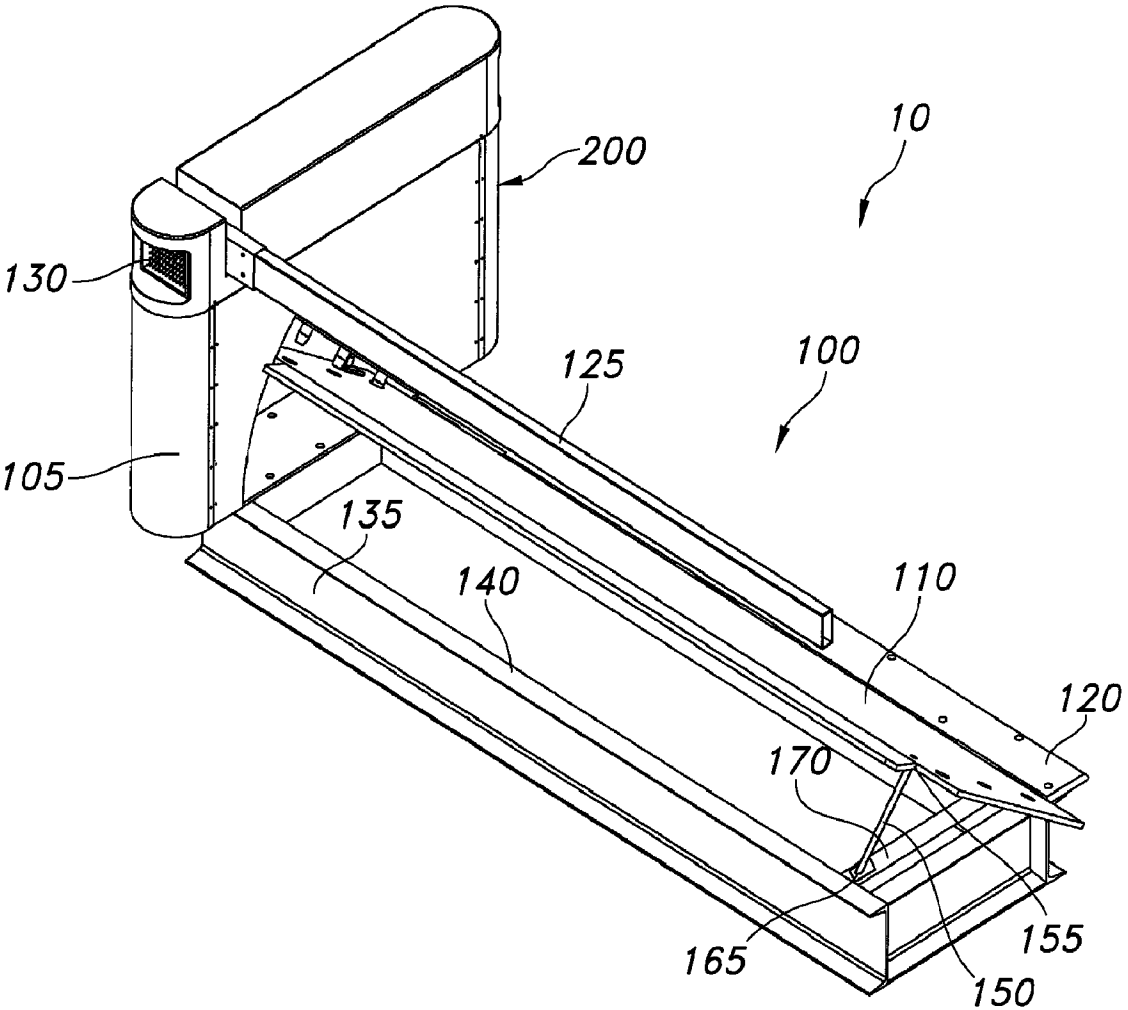
FIG. 9 illustrates a detailed section view of the vehicle barrier control device having flexible support devices and an attachment mechanism in accordance with preferred embodiments of the present invention.

One factor in the design of vehicle barrier control devices 10 is the "clear opening" required of the roadway after the vehicle barrier control device 10 is installed. One of the biggest difficulties is the need to have two buttresses 105, 145 on wide roadways. When two buttresses 105, 145 are used in the roadway, a reduction in the "clear opening" occurs and, thus, causes problems on the roadway. If one buttress 145 is eliminated, however, the vehicle barrier control device 10 may not be sufficiently strong enough to withstand the kinetic energy of a higher-level crash. Accordingly, the present invention utilizes an aircraft grade steel cable 150 on the end of the plate 110 opposite the single buttress 105, as illustrated in FIG. 9. Generally, a first end of the cable 150 is in communication with the plate 110 and a second end of the cable slides into the sub-frame 135 when the plate 110 is lowered to the passive position. When the plate 110 is raised to the active position, the cable 150 is pulled out of the sub-frame 135 until a rod 165 attached to the end of the cable 150 comes in contact with the end of the slide 170 in the sub-frame 135. To aid in the retraction of the cable 150 into the sub-frame 135, a bias 175 (e.g., a spring, not shown) is attached to the sliding end of the cable 150 on the inside of the sub-frame 135.

Figure 10:
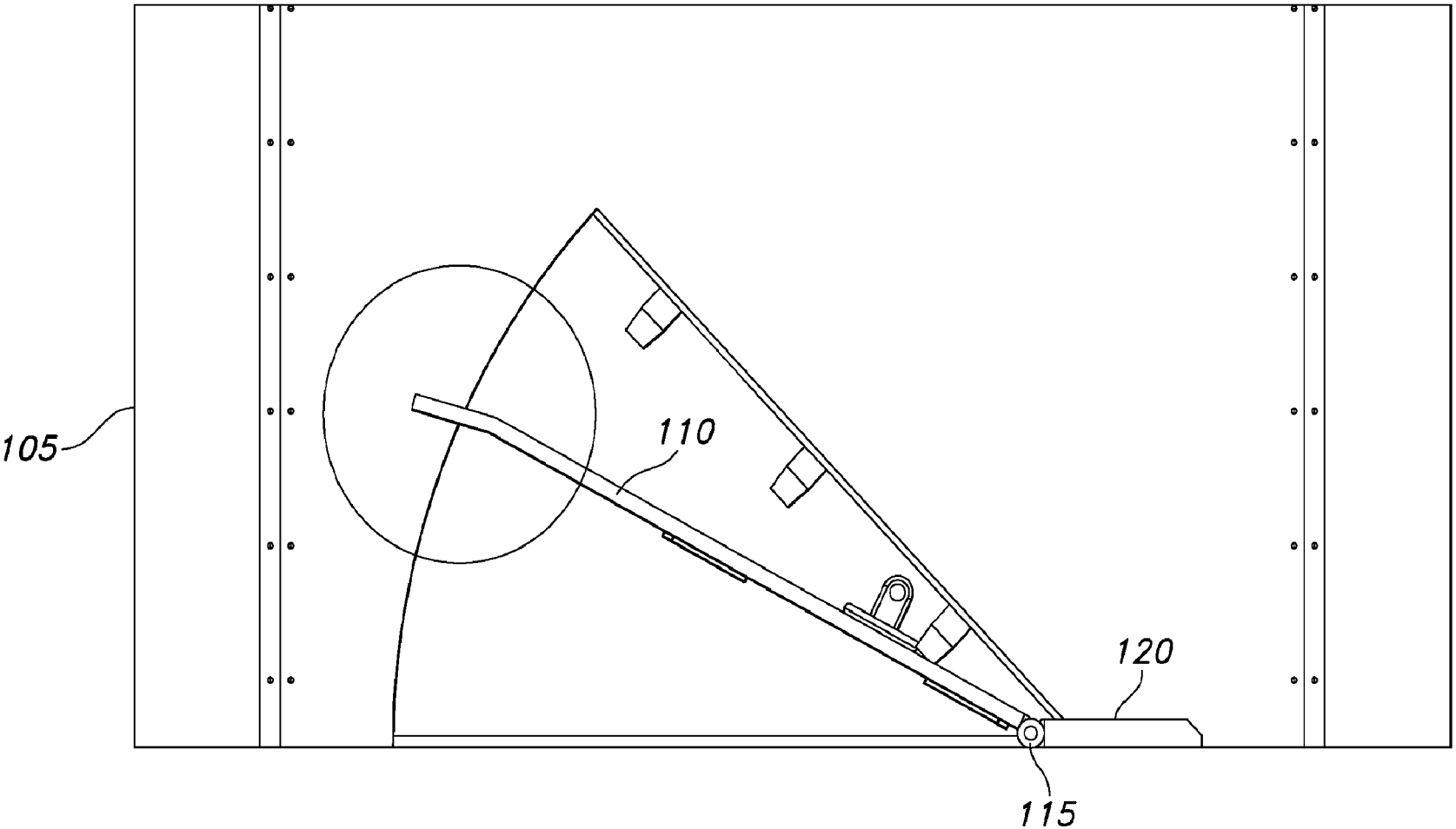
FIG. 10 illustrates a perspective view of a plate having a bend therein of the vehicle barrier control device in accordance with preferred embodiments of the present invention.

As illustrated in FIG. 10, the plate 110 connected to the buttress 105 comprises a bend near the end of the plate 110. Typically, the bend is placed approximately five inches from the end of the plate 110. In a preferred embodiment of the present invention, the offset produced by the bend in the plate 110 is approximately one-half inch. The bend in the plate 110 greatly increases the strength of the plate 110, without having to create a honeycomb or reinforcing structure, and allows the plate 110 to slope downwardly in the front and, therefore, eliminates the "bump" at the front of the plate 110 when a vehicle passes over the plate 110. In other words, by putting a one-half inch bend in the leading edge of the plate 110, a thinner plate 110 can be used and/or a higher crash rating can be achieved.

Numerous characteristics and advantages have been set forth in the foregoing description, together with details of structure and function. While the invention has been disclosed in several forms, it will be apparent to those skilled in the art that many modifications, additions, and deletions, especially in matters of shape, size, and arrangement of parts, can be made therein without departing from the spirit and scope of the invention and its equivalents as set forth in the following claims. Therefore, other modifications or embodiments as may be suggested by the teachings herein are particularly reserved as they fall within the breadth and scope of the claims here appended.

What is claimed is:

1. A vehicle barrier control device comprising:

a movable barrier plate having a first position and a second position, wherein vehicular traffic is permitted when the movable barrier plate is in the first position and vehicular traffic is prohibited when the movable barrier plate is in the second position; and a buttress in communication with the movable barrier plate and comprising a control system operative to reposition the movable barrier plate between the first position and the second position and to dynamically change a speed of the movable barrier plate during repositioning between the first position and the second position.

2. The vehicle barrier control device of claim 1 further comprising:

a traffic control arm in communication with the buttress, wherein the traffic control arm is in a raised position when the movable barrier plate is in the first position and the traffic control arm is in a lowered position when the movable barrier plate is in the second position; and at least one traffic indicating light in communication with the buttress, wherein the traffic indicating light indicates permission for vehicular traffic when the movable barrier plate is in the first position and indicates prohibition to vehicular traffic when the movable barrier plate is in the second position.

3. A vehicle barrier control device comprising:

a movable barrier plate having a first position and a second position, wherein vehicular traffic is permitted when the movable barrier plate is in the first position and vehicular traffic is prohibited when the movable barrier plate is in the second position;

a buttress in communication with the movable barrier plate and comprising a control system operative to reposition the movable barrier plate between the first position and the second position and to dynamically change a speed of the movable barrier plate during repositioning between the first position and the second position; and a subframe installed in a foundation below ground level, wherein the movable barrier plate and the buttress are removably attached to the subframe.

4. The vehicle barrier control device of claim 3, wherein a top of the subframe is generally flush with the ground level.

5. The vehicle barrier control device of claim 3, wherein the foundation comprises a depth of approximately eight inches.

6. The vehicle barrier control device of claim 3, wherein the subframe comprises:

a front anchor member;

a back anchor member;

a first side anchor member; and a second side anchor member, wherein the front anchor member, back anchor member, and first and second side anchor members are arranged to form a perimeter of a rectangle.

7. The vehicle barrier control device of claim 6, the subframe further comprising a plurality of support anchor members positioned generally parallel to the first and second side anchor members, wherein each support anchor member includes a first end in communication with the front anchor member and a second end in communication with the back anchor member.

8. A vehicle barrier control apparatus comprising a movable barrier plate adapted to permit vehicular travel in a first position and to prevent vehicular travel in a second position, wherein the movable barrier plate includes a distal end having a slight bend, such that the slight bend increases the strength of the movable barrier plate and provides a smoother interface between the movable barrier plate and a vehicle, when the movable barrier plate is in the first position; and a control system operative to reposition the movable barrier plate between the first position and the second position and to dynamically change a speed of the movable barrier plate during repositioning between the first position and the second position.

9. The vehicle barrier control apparatus of claim 8, wherein the slight bend is positioned approximately five inches from an edge of the distal end of the movable barrier plate.

10. The vehicle barrier control apparatus of claim 8, wherein the slight bend of the distal end of the movable barrier plate creates an approximately one-half inch offset.

11. The vehicle barrier control apparatus of claim 8 further comprising:

a buttress;

a traffic control arm in communication with the buttress, wherein the traffic control arm is in a raised position when the movable barrier plate is in the first position and the traffic control arm is in a lowered position when the movable barrier plate is in the second position; and at least one traffic indicating light in communication with the buttress, wherein the traffic indicating light is green when the movable barrier plate is in the first position and is red when the movable barrier plate is in the second position.

12. A vehicle barrier control apparatus comprising:

a movable barrier plate having a first position and a second position, wherein vehicular traffic is permitted when the movable barrier plate is in the first position and vehicular traffic is prohibited when the movable barrier plate is in the second position;

a buttress positioned at a first end of the movable barrier plate;

a sliding support cable positioned at a second end of the movable barrier plate opposite the buttress, wherein the sliding support cable assists in maintaining the movable barrier plate in the second position during a vehicular collision;

a modular subframe removably attached to the movable barrier plate and to the buttress; and a control system operative to reposition the movable barrier plate between the first position and the second position and to dynamically change a speed of the movable barrier plate during repositioning between the first position and the second position.

13. The vehicle barrier control apparatus of claim 12, wherein the sliding support cable has a first end attached to the movable barrier plate and a second end attached to a barrier foundation, wherein the sliding support cable is slideably received within the barrier foundation when the movable barrier plate is in the first position.

14. The vehicle barrier control apparatus of claim 13, wherein the second end of the sliding support cable comprises a rod adapted to prevent the sliding support cable from being slideably retracted beyond a predetermined distance from the barrier foundation.

15. The vehicle barrier control apparatus of claim 12 further comprising:

a traffic control arm in communication with the buttress, wherein the traffic control arm is in a raised position when the movable barrier plate is in the first position and the traffic control arm is in a lowered position when the movable barrier plate is in the second position; and at least one traffic indicating light in communication with the buttress, wherein the traffic indicating light is a first color when the movable barrier plate is in the first position and is a second color when the movable barrier plate is in the second position.

16. A vehicle barrier control system comprising:

a movable barrier plate adapted to permit vehicular travel over the movable barrier plate when configured in a passive position flush with the ground and to prevent vehicular travel over the movable barrier plate when configured in an active position raised from the ground;

an actuator adapted to move the movable barrier plate between the passive and active positions; and a control system adapted to control movement of the actuator, wherein the control system includes a three-phase alternating current (AC) induction motor adapted to drive the actuator and a variable frequency drive adapted to dynamically control a speed of the actuator, during repositioning of the movable barrier plate between the passive and active position such that the speed of the actuator affects movement speed of the movable barrier plate between the passive and active positions without the use of flow control valves.

17. The vehicle barrier control system of claim 16, wherein the variable frequency drive is further adapted to provide an emergency operational speed to raise the movable barrier plate between the passive position and the active position at a higher rate of speed.

18. The vehicle barrier control system of claim 16, wherein the variable frequency drive is further adapted to reverse the actuator without utilizing directional control valves.

* * * * *